US005213951A

United States Patent [19]

Delfino

[11] Patent Number: 5,213,951

[45] Date of Patent: May 25, 1993

[54] SILVER HALIDE PHOTOGRAPHIC MATERIAL WITH REDUCED SENSITIZING DYE STAIN

[75] Inventor: Gerolamo Delfino, Savona, Italy

[73] Assignee: Minnesota Mining and Manufacturing Company, St. Paul, Minn.

[21] Appl. No.: 729,475

[22] Filed: Jul. 12, 1991

[30] Foreign Application Priority Data

Jul. 20, 1990 [IT] Italy ..... 20999 A/90

[51] Int. Cl.[5] ..... G03C 1/83; G03C 1/06

[52] U.S. Cl. ..... 430/504; 430/522; 430/567; 430/966

[58] Field of Search ..... 430/220, 522, 517, 512, 430/220, 522, 517, 512, 579, 504, 560, 966, 961, 567

[56] References Cited

U.S. PATENT DOCUMENTS

| | | | |
|---|---|---|---|
| 3,178,285 | 4/1965 | Anderau et al. | 430/512 |
| 3,802,881 | 4/1974 | Land et al. | 430/220 |
| 3,996,050 | 12/1976 | Land | 430/220 |
| 4,425,425 | 1/1984 | Abbott et al. | 430/966 |
| 4,520,098 | 5/1985 | Dickerson | 430/495 |
| 4,818,675 | 4/1989 | Miyasaka et al. | 430/567 |

*Primary Examiner*—Charles L. Bowers, Jr.
*Assistant Examiner*—Mark F. Huff
*Attorney, Agent, or Firm*—Gary L. Griswold; Walter N. Kirn; Mark A. Litman

[57] ABSTRACT

A silver halide photographic material having at least one silver halide light-sensitive emulsion layer on at least one side of a support, wherein said silver halide emulsion layer comprises tabular silver halide grains having a grain thickness of 0.3 μm or less and accounting for at least 50% of the total projected area, wherein a blue pigment having a maximum absorption wave length of from 570 to 630 nm is present in said silver halide emulsion layer and/or in another hydrophilic layer of the photographic material.

20 Claims, No Drawings

SILVER HALIDE PHOTOGRAPHIC MATERIAL WITH REDUCED SENSITIZING DYE STAIN

FIELD OF THE INVENTION

The present invention relates to a light sensitive silver halide photographic material, having reduced sensitizing dye stain, and, in particular, to a light sensitive silver halide photographic material comprising tabular silver halide grains.

BACKGROUND OF THE INVENTION

The covering power of a silver halide emulsion is a matter of a great concern for emulsion makers, because the amount of silver required to maintain a given optical density can be decreased by using an emulsion having a high covering power. It is disclosed in U.S. Pat. Nos. 4,411,986, 4,434,226, 4,413,053, 4,414,304, 4,414,306, 4,435,501 that the covering power of developed silver can be greatly increased by using tabular grain emulsions having a high aspect ratio (i.e., diameter to thickness ratio) and a small grain thickness.

It is known that the use of tabular grains of a highly sensitive emulsion having a small average grain thickness provides high covering power for silver, as compared with the covering power of emulsions which have a large average grain size and a large average grain thickness.

Moreover, the use of intermediate (from 5:1 to 8:1) and high (more than 8:1) aspect ratio tabular grain emulsions can produce increased image sharpness, and improved speed-granularity relationships. In radiographic elements with emulsion coatings on each of the two opposite faces of the support, marked reductions in crossover have been observed using intermediate and high aspect ratio tabular grain emulsions.

A disadvantage that has been discovered with the use of spectrally sensitized tabular grain silver halide emulsions is related to a bad color tone of developed silver of emulsion grains. The color tone of developed silver of emulsion grains depends upon the grain size and grain thickness. The tone of tabular grains is yellowish, and gives an unfavorable impression to the observer of the resulting picture image. This yellowishness is caused by the strong yellowish light produced by the increase in scattering of blue light due to decrease in size and thickness of the grains. In order to solve such a problem, a tone regulating agent is generally used. For example, a certain kind of mercapto compound may be used for this purpose. However, application of such a conventionally known tone regulating agent to an emulsion having tabular grains causes extreme desensitization, and thus, such an emulsion cannot be put into practice.

Japanese Laid Open Patent No. 158,436/1985 discloses a technique for improving the color tone of a silver image by including a fluorescent brightener in a sensitive material comprising an emulsion of tabular silver halide grains having a grain size of 5 times or more the grain thickness.

U.S. Pat. No. 4,818,675 discloses a technique for improving blackness of a silver image by including a dye having a maximum.. absorption wavelength of from 520 to 580 nm in a sensitive material comprising an emulsion of tabular silver halide grains having a thickness of 0.4 μm or less.

Another disadvantage relates to the formation of dye stain caused by the residual spectral sensitizing dye which remains in the photographic element at the end of the processing. Dye stain can be undesirable in altering image tone. Variations in image tone are particularly undesirable in radiography, since this can complicate proper interpretation of X-ray images. Further, residual dye stain is highly objectionable in that it does not affect all wavelengths equally.

U.S. Pat. No. 4,520,098 discloses a technique for improving dye stain of a silver image by including, in proximity to the spectrally sensitized tabular grains, relatively fine high iodide silver halide grains capable of being dissolved during fixing.

SUMMARY OF THE INVENTION

The present invention relates to a silver halide photographic material having at least one silver halide light-sensitive emulsion layer on at least one side of a support, wherein said silver halide emulsion layer comprises tabular silver halide grains having a grain thickness of 0.3 μm or less and accounting for at least 50% of the total projected area, wherein a blue pigment having a maximum absorption wavelength of from 570 to 630 nm is present in said silver halide emulsion layer and/or in another hydrophilic layer of said material.

It has been found that the introduction of said pigment in said silver halide emulsion layer and/or in another hydrophilic layer dramatically reduces dye stain in the photographic material containing silver halide tabular grains.

U.S. Pat. No. 3,705,807 discloses a radiographic material which can be handled under safety lights of high intensity without risks of undue exposure by means of a blue filter dye. Nothing in this patent discloses the specific problem of residual dye stain in radiographic materials containing tabular silver halide grains as well as the use of such a blue pigment to solve this problem.

DETAILED DESCRIPTION OF THE INVENTION

Accordingly, the present invention relates to a silver halide photographic material having at least one silver halide light-sensitive emulsion layer on at least one side of a support, wherein said silver halide emulsion layer comprises tabular silver halide grains having a grain thickness of 0.3 μm or less and accounting for at least 50% of the total projected area, wherein a blue pigment having a maximum absorption wavelength of from 570 to 630 nm is present in said silver halide emulsion layer and/or in another hydrophilic layer of said material.

In a particular embodiment of the present invention, said blue pigment has a maximum absorption wavelength of from 580 to 620 nm, more preferably of from 590 to 610 nm.

Pigments useful in the practice of the present invention are pigments which remain in the layer to which they are added after the developing treatment (i.e., said pigments are relatively unaltered by imaging and processing, relatively unaltered meaning that the optical density of the layer containing the pigment changes by less than 20%, preferably by less than 10%). As known in the art, pigments are organic or inorganic insoluble colored compounds. Theorically, the term "insoluble" is referred to any solvent. Pratically, "insoluble" is at least referred to water and to the solvent in which the pigments are to be used. They are always incorporated into the materials to be colored by means of dispersion. In a particular embodiment said pigments are organic insoluble colored compounds. As they are required to be insoluble in water and in organic solvents, they must have a high molecular weight and lack solubilizing groups. Solubilizing groups are groups such as carboxylic group, sulfonic group, salt groups, hydroxylic group, and the like. More detailed characteristics of pigments are described, for example, in "The Chemistry of Synthetic Dyes", K. Venkateraman, Volume V, Chapter VI. Other references can be found in "Colour Index", The Society of Dyers and Colourists, Volume 2, Pigments. In a preferred embodiment of the present invention, such pigments may be selected from the group of phthalocyanine pigments of the following formula:

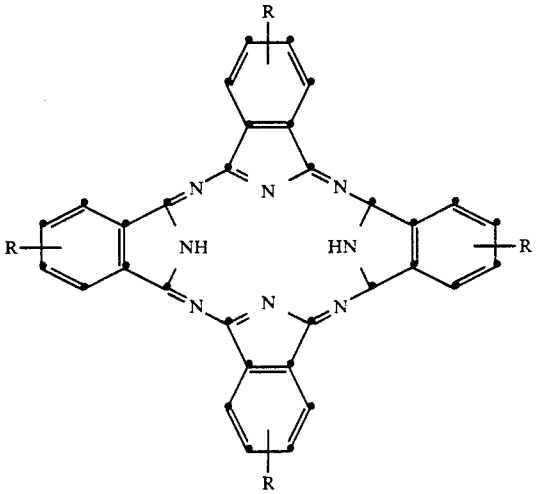

wherein R independently may be H or any insolubilizing group; examples of insolubilizing group may be selected from straight or branched alkyl, such as methyl, ethyl, isopropyl, butyl, etc., cyclic alkyl, such as cyclopentyl, cyclohexyl, etc., aryl, such as phenyl, naphthyl, etc., alkoxy, such as methoxy, ethoxy, butoxy, etc., aryloxy, such as phenoxy, etc., alkylaryl. alkoxyaryl, aralkyl, each of them substituted or unsubstituted, ester group, halides, $—NO_2$, $—SO_3Ba_{178}$ and the like.

In a more preferred embodiment such pigments may be selected from metal phthalocyanine pigments of the following formula:

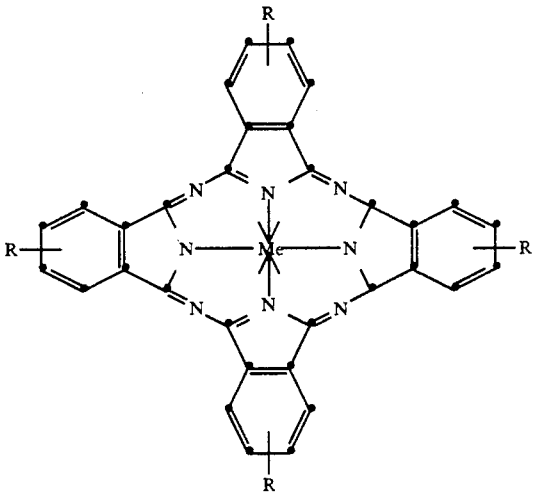

wherein R is the same as defined above and Me is a divalent metallic atom. Examples of divalent metallic atoms are Cu, Co, Mn, Sn, Pb, Ni, Zn, Fe, Mg and the like.

Specific pigments to be used in the present invention are shown below. However, the present invention is not limited to these pigments. Other useful pigments can be found in "Colour Index", The Society of Dyers and Colourists, Volume 2, Pigments, "Phthalocyanine Compounds", F. H. Moser, A. L. Thomas, Reinhold Publishing Corporation, "The Chemistry of Synthetic Dyes and Pigments", H. A. Lubs, Reinhold Publishing Corporation, and "Chemistry and Physics of Organic Pigments", L. S. Pratt, John Wiley & Sons, Inc.

(I)

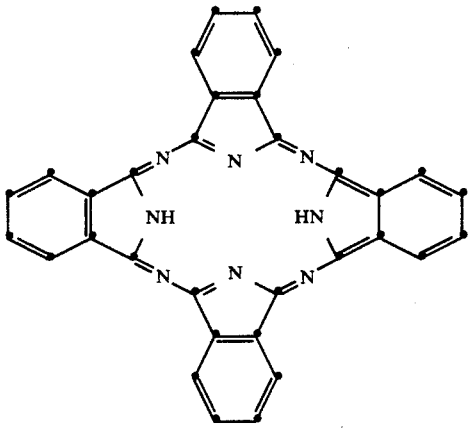

-continued
(II)
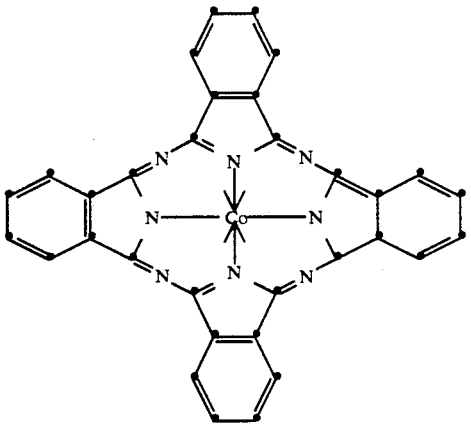
(III)
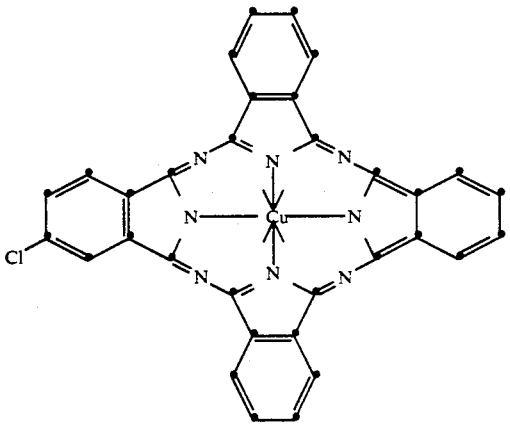
(IV)
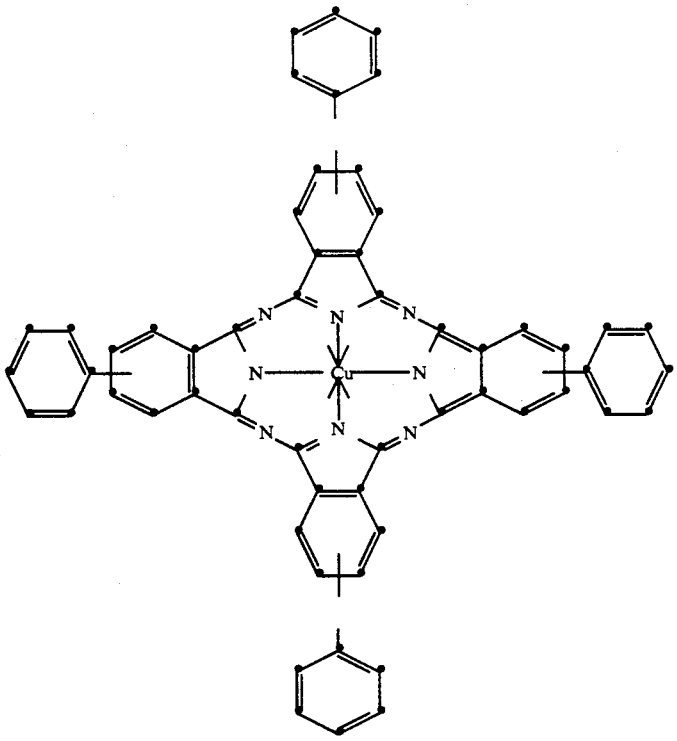

-continued (V)

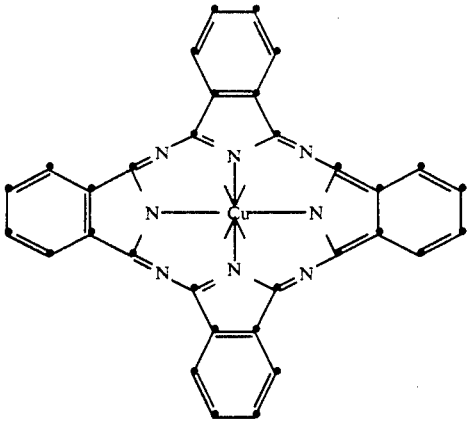

The pigment to be used in the present invention can be dispersed in a silver halide emulsion layer and/or other hydrophilic layers (e.g. an intermediate layer, a protective layer, an anti-halo layer, a filter layer and the like) by means of (1) directly dispersing the fine divided pigment in the silver halide emulsion layer or other hydrophilic colloid layers, or (2) dispersing the pigment in water or in an organic solvent and then introducing the dispersion in the emulsion layer or the hydrophilic layer. The second method is preferred. In particular, it is preferred to use pigment dispersions or pastes manufactured and sold under brand names by various manufacturers, e.g., Sun Chemical Co., Hoechst Chemical Co., Sandoz Ltd., Imperial Chemical Industries Ltd., BASF A. G., Imperial Color Chemical & Paper Co., IG Farbenindustrie A. G., E. I. DuPont de Nemours & Co. Inc., etc. Examples of said paste brand names are Monastral, Predisol, Hostaperm, Sandorin, Monarch, Colanyl, Heliogen, Sunfast. Nevertheless, any useful methods known in the art can be used to disperse the pigments. References can be found in "Phthalocyanine Compounds", F. H. Moser, A. L. Thomas, Reinhold Publishing Corporation, "The Chemistry of Synthetic Dyes and Pigments", H. A. Lubs, Reinhold Publishing Corporation, and "Chemistry and Physics of Organic Pigments", L. S. Pratt, John Wiley & Sons, Inc.

The amount of the pigment to be added is of from 0.001 to 0.5 g/m$^2$, preferably of from 0.005 to 0.1 g/m$^2$, more preferably of from 0.005 to 0.05 g/m$^2$ although the amount depends on the kind of pigment and its absorbance. In any case the amount of the blue pigment used in the present invention is so that the optical density, measured at 632 nm, of the layer containing said pigment is in the range of from 0.01 to 0.1, preferably of from 0.02 to 0.05 after the developing treatment.

The light-sensitive silver halide photographic material of this invention may be a photographic color material such as color negative film, color reversal film, color paper, etc., as well as black-and-white photographic material such as X-ray light-sensitive material, black-and-white photographic printing paper, black-and-white negative film, etc.

In a particular embodiment the photographic material of the present invention may be an X-ray photographic material which comprises a polymeric base of the type commonly used in radiography, for instance a polyester base, in particular a polyethylene terephthalate base.

On at least one surface, preferably on both surfaces of the base there is coated a silver halide emulsion layer in a hydrophilic colloid. The emulsions coated on the two surfaces may also be different and comprise emulsions commonly used in photographic elements, such as silver chloride, silver iodide, silver chloro-bromide, silver chloro-bromo-iodide, silver bromide and silver bromo-iodide emulsions, the silver bromo-iodide emulsions being particularly useful for the X-ray elements. The silver halide crystals may have different shapes, for instance cubic, octahedral, spherical, tabular shapes, and may have epitaxial growth. In the practice of the present invention the photographic material contains at least one silver halide light-sensitive emulsion layer which comprises tabular silver halide grains having a thickness of 0.3 $\mu$m or less and accounting for at least 50% of the total projected area of the silver halide grains present in the emulsion.

The emulsions are coated on the base at a total silver coverage comprised in the range from about 2 to 6 g/m$^2$, preferably 3 to 5 g/m$^2$. The silver halide binding material used is a water-permeable hydrophilic colloid, which is preferably gelatin, but other hydrophilic colloids, such as gelatin derivatives, albumin, polyvinyl alcohol, alginates, cellulose hydrolized esters, hydrophilic polyvinyl polymers, dextrans, polyacrylamides, alkylacrylates and acry lamide hydrophilic copolymers can also be used, alone or in combination with gelatin.

Silver halide emulsions containing tabular silver halide grains can be prepared with various processes known in the conventional technology for the preparation of photographic materials. Silver halide emulsions can be prepared by the acid process, neutral process or ammonia process. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp. 121–125, in Gutoff, "Nucleation and Growth Rates During the Precipitation of Silver Halide Photographic Emulsions", Photographic Science and Engineering, Vol. 14, No. 4 (1970), pp. 248–257,in Berry et al., "Effects of Environment on the Growth of Silver Bromide Microcrystals", Vol. 5, No. 6 (1961), pp. 332–336, in U.S. Pat. Nos. 4,063,951, 4,067,739, 4,184,878, 4,434,226, 4,414,310, 4,386,156, 4,414,306, in EP Pat. Appln. No. 263,508 and in Research Disclosure, Item 22534, January 1983.

In preparing the silver halide emulsions containing tabular silver halide grains, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as described above.

The silver halide emulsions containing tabular silver halide grains used in the present invention can be chemically and optically sensitized with methods well known in the art. The silver halide emulsion layer containing the tabular silver halide grains of this invention can contain other constituents generally used in such products, such as binders, hardeners, surfactants, speed-increasing agents, plasticizers, optical sensitizers, dyes, ultraviolet absorbers, etc., and reference can be made to, for example, Research Disclosure, Vol. 176 (December 1978), pp. 22–28. Ordinary silver halide grains may be incorporated in the emulsion layer containing the tabular silver halide grains as well as in other silver halide emulsion layers of the light-sensitive silver halide photographic material of this invention. Such grains can be prepared by processes well known in the photographic art.

Tabular silver halide grains are defined as those having two substantially parallel major crystal faces. The term tabular grain emulsion is defined as requiring that the tabular silver halide grains having a thickness of 0.3 μm or less account for at least 50% of the total projected area of the silver halide grains present in the emulsion.

Preferred tabular grain emulsions are intermediate and high aspect ratio tabular grain emulsions. As applied to tabular grain emulsions, the term "high aspect ratio" is defined as requiring that the silver halide grains having a thickness of 0.3 μm or less and a diameter of at least 0.6 μm have an average aspect ratio of at least 8:1 and account for at least 50% of the total projected area of the silver halide grains present in the emulsion. The term is thus defined in conformity with the term used in the patents relating to tabular grain emulsions cited above.

The term "intermediate aspect ratio" as applied to tabular grain emulsions is defined as requiring that the tabular silver halide grains having a thickness of 0.3 μm or less and a diameter of at least 0.6 μm have an average aspect ratio in the range of from 5:1 to 8:1 and account for at least 50% of the total projected area of the silver halide grains present in the emulsion. The term "thin intermediate aspect ratio" is similarly defined, except that the reference thickness of 0.3 μm is replaced by a reference thickness of 0.2 μm.

The grain characteristics described above of the tabular silver halide grains can be readily ascertained by procedures well known to those skilled in the art. The term "diameter" is defined as the diameter of a circle having an area equal to the projected area of the grain. The term "thickness" means the distance between the two substantially parallel main planes constituting the tabular silver halide grains. From the measure of diameter and thickness of each grain the diameter:thickness of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice it is simpler to obtain an average diameter and an average thickness of the tabular grains and to calculate the average diameter:thickness ratio as the ratio of these two averages. Whatever the used method may be, the average diameter:thickness ratios obtained do not significantly differ.

According the present invention in the silver halide emulsion layer containing tabular silver halide grains, at least 50% of the silver halide grains are tabular grains having a thickness of 0.3μm or less and an average diameter:thickness ratio of at least 5:1. More preferably, at least 70% of the silver halide grains are tabular grains having a thickness of 0.3μm or less and an average diameter:thickness ratio of not less than 5:1. Each of the above proportions, "50%" and "70%" means the proportion of the total projected area of the tabular grains having a diameter:thickness ratio of at least 5:1 to the projected area of all of the silver halide grains in the layer. Other conventional silver halide grain structures such as cubic, orthorhombic, tetrahedral, etc. may make up the remainder of the grains.

The preferred spectral sensitizing dyes for radiographic elements are chosen to exhibit an absorption peak shift in their absorbed state, normally in the J-band, to a region of the spectrum corresponding to the wavelength of electromagnetic radiation to which the element is intended to be image-wise exposed. The electromagnetic radiation producing image-wise exposure is typically emitted from phosphors of intensifying screens. A separate intensifying screen exposes each of the two imaging units located on opposite sides of the support. The intensifying screen can emit light in the ultraviolet, blue, green or red portions of the spectrum, depending upon the specific phosphors chosen for incorporation therein. In a specifically preferred form phosphors emitting in the green portion of the spectrum are chosen.

It is known in the art of radiographic photographic material that the intensity of the sharp absorption band (J-band) shown by the spectral sensitizing dye absorbed on the surface of the light-sensitive silver halide grains will vary with the quantity of the specific dye chosen as well as the size and chemical composition of the grains. The maximum intensity of J-band has been obtained with silver halide grains having the above described sizes and the chemical compositions absorbed with J-band spectral sensitizing dyes in a concentration of from 25 to 100 percent or more of monolayer coverage of the total available surface area of said silver halide grains. Optimum dye concentration levels can be chosen in the range of 0.5 to 20 millimoles per mole of silver halide, preferably in the range of 2 to 10 millimoles.

The J-band spectral sensitizing dyes are preferably added to the silver halide emulsions in the presence of a water soluble iodide or bromide salt. The J-band exhibited by said dyes absorbed on said grains is increased by the presence of said salts, increasing the strong coloration of the element before processing and consequently reducing the cross-over of exposing radiations by adding a smaller amount of dye. Said salts are more advantageously added to the silver halide emulsion before dye digestion, that is the pause following dye addition; said pause is preferably made at a temperature of 40° to 60° C. for a time of about 50 to 150 minutes.

Typical water soluble salts include alkali metal, alkali earth metal and ammonium iodide and bromide such as ammonium, potassium, lithium, sodium, cadmium and strontium iodides and bromides. The amount of said water soluble iodide and bromide salts is advantageously in a range of from 50 to 5,000 mg per mole of silver, and preferably from 100 to 1,000 mg per mole of silver. We have surprisingly found that the use of the blue pigment of the present invention reduces the quantity needed of said salts to obtain the same effect shown by a radiographic element without said blue pigment.

Spectral sensitizing dyes producing J aggregates are well known in the art, as illustrated by F. M. Hamer, *Cyanine Dyes and Related Compounds,* John Wiley and Sons, 1964, Chapter XVII and by T. H. James, *The Theory of the Photographic Process,* 4th edition, Macmillan, 1977, Chapter 8.

In a preferred form, J-band exhibiting dyes are cyanine dyes. Such dyes comprise two basic heterocyclic nuclei joined by a linkage of methine groups. The heterocyclic nuclei preferably include fused benzene rings to enhance J aggregation. The heterocyclic nuclei are preferably quinolinium, benzoxazolium, benzothiazolium, benzoselenazolium, benzimidazolium, naphthoxazolium, naphthothiazolium and naphthoselenazolium quaternary salts.

It is known in the photographic art that photographic speed obtainable from the silver halide grains increases with the increasing concentration of the sensitizing dye until maximum speed is obtained with an optimum dye concentration, after that, further increases in dye concentration cause a decrease in the obtainable speed. The optimum amount of sensitizing dye employed can vary depending upon the specific sensitizing dye, as well as upon the size and aspect of the grains.

In addition to the features specifically described above, the photographic elements of this invention, in the light-sensitive silver halide emulsion layers or in other layers, can include additional addenda of conventional nature, such as stabilizers, antifoggants, brighteners, absorbing materials, hardeners, coating aids, plasticizers, lubricants, matting agents, antikinking agents, antistatic agents, and the like, as described in Research Disclosure, Item 17643, December 1978 and in Research Disclosure, Item 18431, August 1979. Research Disclosure is published by Kennet Mason Publication, Ltd., The Old Harbourmaster's, 8 North Street, Emsworth, Hampshire, England.

Preferred radiographic elements are of the type described in BE Patent 757,815, in U.S. Pat. Nos. 3,705,858, 4,425,425, 4,425,426 and 4,413,053, i.e. elements wherein at least one light-sensitive silver halide emulsion layer is coated on both surfaces of a transparent support, the total silver coverage per surface unit for both layers being lower than about 6 g/m$^2$, preferably than 5 g/m$^2$. Such supports are preferably polyester film supports, such as polyethylene terephthalate films. Generally said supports for use in medical radiography are blue tinted. Preferred dyes are anthraquinone dyes, such as those described in U.S. Pat. Nos. 3,488,195; 3,849,139; 3,918,976; 3,933,502; 3,948,664 and in UK Patents 1,250,983 and 1,372,668.

The exposed radiographic elements can be processed by any of the conventional processing techniques. Such processing techniques are illustrated for example in Research Disclosure, Item 17643, cited above. Roller transport processing is particularly preferred, as illustrated in U.S. Pat. Nos. 3,025,779; 3,515,556; 3,545,971 and 3,647,459 and in UK Patent 1,269,268. Hardening development can be undertaken, as illustrated in U.S. Pat. No. 3,232,761.

As regards the processes for the silver halide emulsion preparation and the use of particular ingredients in the emulsion and in the light-sensitive element, reference is made to Research Disclosure 18,431 published in August 1979,, wherein the following chapters are dealt with in deeper details:

IA. Preparation, purification and concentration methods for silver halide emulsions.
IB. Emulsion types.
IC. Crystal chemical sensitization and doping.
II. Stabilizers, antifogging and antifolding agents.
IIA. Stabilizers and/or antifoggants.
IIB. Stabilization or emulsions chemically sensitized with gold compounds.
IIC. Stabilization of emulsions containing polyalkylene oxides or plasticizers.
IID. Fog caused by metal contaminants.
IIE. Stabilization of materials comprising agents to increase the covering power.
IIF. Antifoggants for dichroic fog.
IIG. Antifoggants for hardeners and developers comprising hardeners.
IIH. Additions to minimize desensitization due to folding.
III. Antifoggants for emulsions coated on polyester bases.
IIJ. Methods to stabilize emulsions at safety lights.
IIK. Methods to stabilize x-ray materials used for high temperature. Rapid Access, roller processor transport processing.
III. Compounds and antistatic layers.
IV. Protective layers.
V. Direct positive materials.
VI. Materials for processing at room light.
VII. X-ray color materials.
VIII. Phosphors and intensifying screens.
IX. Spectral sensitization.
X. UV-sensitive materials
XII. Bases and to Research Disclosure, Item 308119, December 1989, wherein the following chapters are dealt with in deeper details:

I. Emulsion preparation and types
II. μmulsion washing
III. Chemical sensitization
IV. Spectral sensitization and desensitization
V. Brighteners
VI. Antifoggant and stabilizer
VIII. Absorbing and scattering material
IX. Vehicle and vehicle extenders
X. Hardeners
XI. Coating aids
XII. Plasticizers and lubricants
XIII. Antistatic layers
XIV. Methods of addition
XV. Coating and drying procedure
XVI. Matting agents
XVII. Supports The present invention is now illustrated by reference to the following example.

EXAMPLE

A tabular grain silver bromide emulsion (having an average diameter to thickness ratio of about 8:1) was chemically sensitized with sodium paratoluensulfinate, sodium thiosulfate pentahydrate, gold (III) chloride, potassium thiocyanate, potassium chloropalladite, spectrally sensitized with anhydro-5,5'-dichloro-9-ethyl-3,3'-di(3-sulfopropyl)-oxacarbocyanine hydroxide and stabilized with 5-methyl-7-hydroxy-1,3,4-triazaindolizine.

At the end the emulsion was divided in two portions. The first portion was digested with 400 mg of KI per mole of Ag (emulsion A), the second portion was digested with 350 mg of KI per mole of Ag (emulsion B). Three different quantities of Colanyl Blue AR TM manufactured by Hoechst Chemical Co., and containing a dispersion in water of about 40% of the compound (V) above described were added to three different portions of emulsion A and B (em. A1, A2, A3 and B1, B2, B3).

Then each emulsion was coated on both sides of two subbed polyethylene terephthalate support bases (A and B) blue tinted with an anthraquinone dye (support base A having an optical density, measured at 632 nm of 0.313, support base B having an optical density, measured at 632 nm of 0.284), at a total silver coverage of 4 g/m$^2$, and hardened. Each of the obtained film was maintained for 15h at 50° C., then exposed to blue, green and red light, and to X-rays with 3M TRIMAX TM T8 intensifying screen, and processed in a 3M TRIMATIC TM XP515 automatic processor using a 3M XAD/2 Developer and a 3MXAF/2 Fixer.

In table 1 the details of the preparation of the emulsions are shown (A0 represent the control). The optical density values are referred to the emulsion layers containing said Colanyl Blue AR TM after developing treatment. In table 2 and 3 are shown the sensitometric results of the films obtained from the two support bases. Table 2 is referred to the support base A, table 3 is referred to the support base B.

The measure of J-band is made with reference to the spectrophotometric curve of each film in the region of 400 to 700 nm by measuring the absorbance at 549 nm, which corresponds to the dye absorbance J-band peak.

TABLE 1

| Emulsion | KI (mg/M of Ag) | Colanyl Blue | Optical density at 632 nm |
|---|---|---|---|
| A0 | 400 | / | / |
| A1 | = | 0.0165 g/m$^2$ | 0.019 |
| A2 | = | 0.0247 g/m$^2$ | 0.030 |
| A3 | = | 0.033 g/m$^2$ | 0.037 |
| B1 | 350 | 0.0165 g/m$^2$ | 0.018 |
| B2 | = | 0.0247 g/m$^2$ | 0.032 |
| B3 | = | 0.033 g/m$^2$ | 0.046 |

TABLE 2

(BASE A)

| Film | DMin | Blue speed | Green speed | Red speed | X-Ray speed | Av. contr. | Hardness | J band |
|---|---|---|---|---|---|---|---|---|
| A0 | 0.20 | 2.08 | 2.50 | 0.21 | 2.50 | 2.50 | 40 | 1.653 |
| A1 | 0.21 | 2.06 | 2.47 | 0.23 | 2.48 | 2.48 | 42 | 1.641 |
| A2 | 0.22 | 2.06 | 2.48 | 0.23 | 2.49 | 2.49 | 40 | 1.660 |
| A3 | 0.23 | 2.07 | 2.48 | 0.24 | 2.48 | 2.48 | 41 | 1.688 |
| B1 | 0.21 | 2.09 | 2.49 | 0.23 | 2.49 | 2.49 | 41 | 1.649 |
| B2 | 0.22 | 2.06 | 2.48 | 0.25 | 2.48 | 2.50 | 42 | 1.673 |
| B3 | 0.23 | 2.05 | 2.45 | 0.25 | 2.45 | 2.49 | 42 | 1.590 |

TABLE 3

(BASE B)

| Film | DMin | Blue speed | Green speed | Red speed | X-Ray speed | Av. contr. | Hardness | J band |
|---|---|---|---|---|---|---|---|---|
| A0 | 0.19 | 2.01 | 2.45 | 0.21 | 2.53 | 2.48 | 41 | 1.631 |
| A1 | 0.20 | 1.99 | 2.43 | 0.22 | 2.52 | 2.50 | 42 | 1.646 |
| A2 | 0.21 | 2.00 | 2.43 | 0.22 | 2.52 | 2.50 | 44 | 1.645 |
| A3 | 0.21 | 2.00 | 2.43 | 0.23 | 2.51 | 2.55 | 41 | 1.668 |
| B1 | 0.20 | 2.01 | 2.43 | 0.21 | 2.51 | 2.64 | 44 | 1.652 |
| B2 | 0.21 | 2.00 | 2.42 | 0.23 | 2.51 | 2.61 | 44 | 1.620 |
| B3 | 0.21 | 1.98 | 2.41 | 0.22 | 2.50 | 2.50 | 41 | 1.612 |

The residual dye stain was measured with a DIANO spectrophotometer, manufactured by DIANO Co. which gives the C.I.E. (1976) L, a*, b*, coordinates. The main characteristics of this spectrophotometer are illumination D65, two observatory degrees and exclusion of specular component. The results of all films are shown in table 4 and 5 in comparison with a XD/A 3M conventional X-ray film having a AgBrI cubic emulsion, with a mean diameter of 0.7 μm, chemically and spectrally sensitized according U.S. Pat. No. 4,777,125, coated at 4.3 g/m$^2$ and having a spectral sensitizer content of 36 mg/m$^2$. In the following tables L means luminosity, a* means green tone and b* means blue tone. Lower values of a* and b* mean a better result in residual dye stain.

TABLE 4

(BASE A)

| Film | L | a* | b* |
|---|---|---|---|
| A0 | 82.47 | −4.51 | −10.47 |
| A1 | 81.87 | −5.36 | −11.76 |
| A2 | 81.10 | −6.04 | −12.65 |
| A3 | 80.49 | −6.33 | −13.42 |
| B1 | 81.46 | −5.45 | −11.89 |
| B2 | 80.95 | −6.07 | −13.04 |
| B3 | 80.54 | −6.79 | −13.71 |
| XD/A | 80.09 | −5.17 | −10.21 |

TABLE 5

| Film | L | a* | b* |
|---|---|---|---|
| | (BASE B) | | |
| A0 | 83.69 | −3.90 | −8.90 |
| A1 | 82.54 | −4.97 | −10.76 |
| A2 | 81.71 | −5.70 | −11.85 |
| A3 | 81.44 | −5.95 | −12.14 |
| B1 | 82.55 | −5.16 | −10.86 |
| B2 | 81.72 | −5.80 | −11.90 |
| B3 | 81.77 | −6.29 | −12.44 |
| XD/A | 80.09 | −5.17 | −10.21 |

I claim:

1. A silver halide photographic material having at least one silver halide light-sensitive emulsion layer on at least one side of a support, wherein said silver halide emulsion layer comprises tabular silver halide grains having a grain thickness of 0.3 μm or less and accounting for at least 50% of the total projected area, characterized in that a blue pigment having a maximum absorption wavelength of from 570 to 630 nm is present in said silver halide emulsion layer and/or another hydrophilic layer of said photographic material.

2. A silver halide photographic material according to claim 1, characterized in that said blue pigment has a maximum absorption wave length of from 580 to 620 nm.

3. A silver halide photographic material according to claim 1, characterized in that said blue pigment has a maximum absorption wave length of from 590 to 610 nm.

4. A silver halide photographic material according to claim 1, characterized in that said blue pigment is selected from the group of phthalocyanine pigments.

5. A silver halide photographic material according to claim 4, wherein said blue pigment has the following formula:

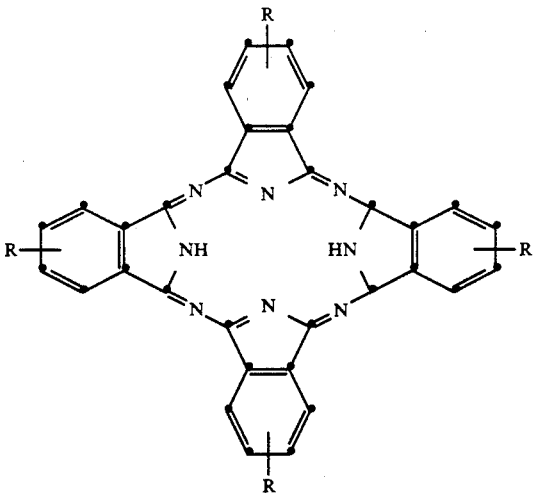

wherein R independently may be H or any insolubilizing group.

6. A silver halide photographic material according to claim 1, characterized in that said blue pigment is selected from the group of metal phthalocyanine pigments.

7. A silver halide photographic material according to claim 6, wherein said blue pigment has the following formula:

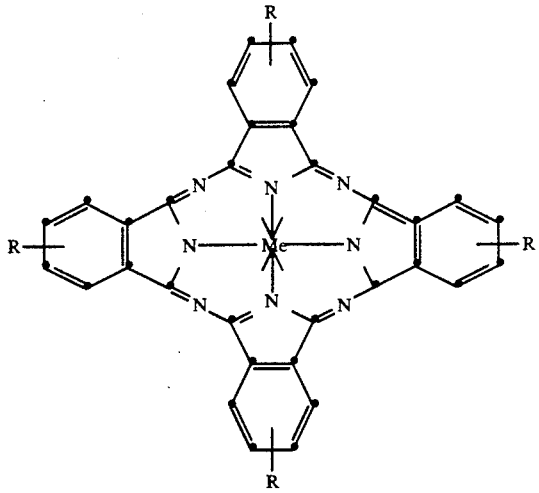

wherein R independently may be H or any insolubilizing group and Me is a divalent metallic atom.

8. A silver halide photographic material according to claim 7 characterized in that said insolubilizing group is selected from straight or branched alkyl, cyclic alkyl, aryl, alkoxy, aryloxy, alkylaryl, alkoxyaryl, aralkyl, each of them substituted or unsubstituted, ester group, halides, $—NO_2$, $—SO_3Ba_{178}$.

9. A silver halide photographic material according to claims 7 characterized in that said divalent metallic atom is selected from Cu, Co, Mn, Sn, Pb, Ni, Zn, Fe, Mg.

10. A silver halide photographic material according to claim 1, characterized in that said blue pigment is added to a silver halide light sensitive emulsion layer.

11. A silver halide photographic material according to claim 1, characterized in that said blue pigment is added to a hydrophilic colloid layer.

12. A silver halide photographic material according to claim 11, characterized in that said hydrophilic colloid layer is a protective layer.

13. A silver halide photographic material according to claim 1 characterized in that said blue pigment is added in an amount of from 0.001 to 0.5 $g/m^2$.

14. A silver halide photographic material according to claim 1 characterized in that said blue pigment is added in an amount so that the optical density, measured at 632 nm, of the layer containing said pigment is in the range of from 0.01 to 0.1, after the developing treatment.

15. A silver halide photographic material according to claim 1 characterized in that said blue pigment is added in an amount so that the optical density, measured at 632 nm, of the layer containing said pigment is in the range of from 0.02 to 0.05, after the developing treatment.

16. A silver halide photographic material according to claim 1 characterized in that the average diameter to thickness ratio of said tabular silver halide grains is of from 5 to 50.

17. A silver halide photographic material having at least one silver halide light-sensitive emulsion layer on at least one side of a support, wherein said silver halide emulsion layer comprises tabular silver halide grains having a grain thickness of 0.3 μm or less and accounting for at least 50% of the total projected area, characterized in that a blue pigment having a maximum absorption wavelength of from 580 to 620 nm is present in a hydrophilic layer of said photographic material which is not a silver halide emulsion layer.

18. A silver halide photographic material according to claim 17, characterized in that said blue pigment is selected from the group of phthalocyanine pigments.

19. A silver halide photographic material according to claim 18, wherein said blue pigment has the following formula:

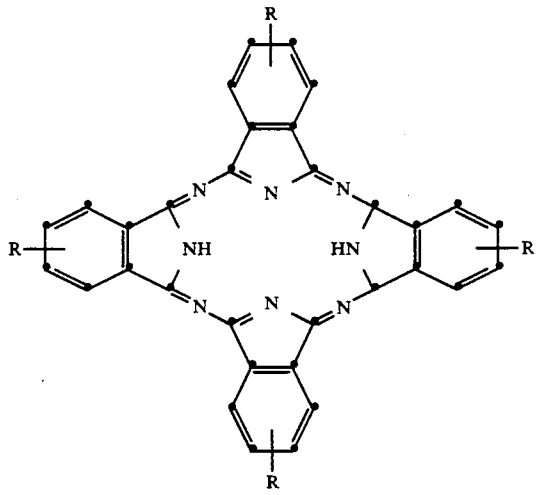

wherein R independently may be H or any insolubilizing group.

20. A silver halide photographic material according to claim 18, wherein said blue pigment has the following formula:

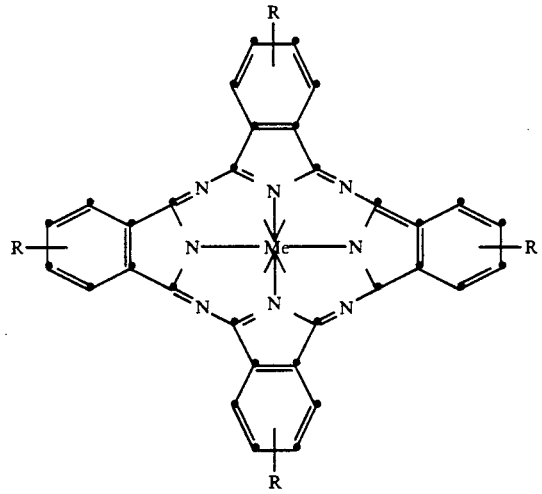

wherein R independently may be H or any insolubilizing group and Me is a divalent metallic atom.

* * * * *